US005266936A

United States Patent [19]

Saitoh

[11] Patent Number: 5,266,936

[45] Date of Patent: Nov. 30, 1993

[54] DRIVING CIRCUIT FOR LIQUID CRYSTAL DISPLAY

[75] Inventor: Sei Saitoh, Tokyo, Japan

[73] Assignee: NEC Corporation, Tokyo, Japan

[21] Appl. No.: 888,811

[22] Filed: May 4, 1992

Related U.S. Application Data

[63] Continuation of Ser. No. 519,918, May 7, 1990, abandoned.

[30] Foreign Application Priority Data

May 9, 1989 [JP] Japan ..... 1-116304
Jun. 7, 1989 [JP] Japan ..... 1-146337

[51] Int. Cl.[5] ..... G09G 3/36
[52] U.S. Cl. ..... 345/98; 345/89
[58] Field of Search ..... 340/784, 793, 805, 811; 359/54, 55, 58

[56] References Cited

U.S. PATENT DOCUMENTS

| | | | |
|---|---|---|---|
| 4,488,150 | 12/1984 | Kanatani | 340/793 |
| 4,734,686 | 3/1988 | Okamota et al. | 340/805 |
| 4,748,444 | 5/1988 | Arai | 340/784 |
| 4,781,437 | 11/1988 | Shield et al. | 340/784 |
| 4,825,202 | 4/1989 | Dijon et al. | 340/784 |
| 4,955,696 | 9/1990 | Taniguichi et al. | 350/333 |
| 4,962,376 | 10/1990 | Inoue et al. | 340/784 |

*Primary Examiner*—Ulysses Weldon

*Assistant Examiner*—Regina Liang

*Attorney, Agent, or Firm*—Laff, Whitesel, Conte & Saret

[57] ABSTRACT

A driving circuit for a liquid crystal display comprises: a selector driving circuit having a plurality of shift registers and latch circuits for outputting hold signals latched in the latch circuits; a plurality of selector circuits each for selecting one reference voltage corresponding to the hold signal; a plurality of hold capacitors each being charged by the selected reference voltage; and a plurality of source follower circuits each receiving the hold voltage from the hold capacitor and outputting a driving voltage for the liquid crystal display. The driving circuit further comprise a plurality of comparator circuits each receiving the output driving voltage and the reference voltage selected and switching the connection of a ramp voltage to the hold capacitor. Each source follower circuit provided for each stage requires a constant current source and only one output driver transistor instead of as many transistors as the number of gradations, which transistor commonly operates over all the gradations. The driving circuit may comprise a plurality of level shifting or biasing circuits supplying to the respective selector circuits level-shifted reference voltages whose potentials are higher than the normal reference voltages by the amount of a biasing voltage applied to the constant current sources of the source follower circuits.

6 Claims, 6 Drawing Sheets

DRIVING CIRCUIT FOR LIQUID CRYSTAL DISPLAY

This application is a continuation of application Ser. No. 07/519,918, filed May 7, 1990 now abandoned.

BACKGROUND OF THE INVENTION

The present invention relates to a driving circuit for a liquid crystal display and, more particularly, to a driving circuit for an active matrix type liquid crystal display, which is simple in its construction and suitable to be fabricated in an integrated circuit device.

The panel display of an active matrix liquid crystal is controlled by a driving circuit to which digital image or video signals are inputted.

In a conventional driving circuit for a liquid crystal display, the number of output transistors had to be increased accordingly with an increase in the number of gradations of brightness. Assuming here that the necessary number of gradations was 16 and the number of stages was 100, the number of output driver transistors required was 1,600. The use of such a driving circuit in an integrated circuit device results in not only a large chip area therefor but also a high manufacturing cost. Further, such a circuit having a large number of the output driver transistors required the power supply circuit having a larger driving capability increased proportionally to the number of gradations.

SUMMARY OF THE INVENTION

It is, therefore, an object of the invention to eliminate the problems existing in the conventional driver circuit described above and to provide an improved driving circuit for a liquid crystal display.

It is another object of the invention to provide a driving circuit for a liquid crystal display which requires a smaller chip area as compared to the area required by the conventional one when the number of the gradations and the number of the stages therein are the same as those in the conventional one.

It is further object of the invention to provide a driving circuit for a liquid crystal display, which is suitable to be fabricated in an integrated circuit device with a high integration density.

It is still further object of the invention to provide an integrated circuit device having a high integration or packing density and a driving circuit for a liquid crystal display which is capable of controlling a number of gradations.

According to one aspect of the present invention, there is provided a driving circuit for a liquid crystal display of an active matrix type, the circuit comprising:

a selector driving circuit having a plurality of shift registers connected in cascade for transferring therethrough the inputted image signals and a plurality of latch circuits for holding the image signals transferred respectively from the shift registers and for outputting such hold signals;

a plurality of selector circuits each of which selects from among a plurality of inputted reference voltages one reference voltage corresponding to the hold signal and outputs the reference voltage selected;

a plurality of sampling circuits each of which commonly receives a ramp voltage changing its level proportionally with respect to the time and includes a sampling capacitor and a sampling switch for controlling a sample holding operation;

a plurality of source follower circuits each of which receives a sample hold voltage from the sampling capacitor and outputs a driving voltage for the liquid crystal display; and a plurality of comparator circuits each of which receives the output driving voltage from the source follower circuit and the selected reference voltage from the selector circuit, compares the levels of the respective voltages and drives the sampling switch at the time when both the compared voltages become identical with each other.

According to another aspect of the present invention, there is also provided a driving circuit for a liquid crystal display of an active matrix type, the circuit comprising:

a selector driving circuit having a plurality of shift registers connected in cascade for transferring therethrough the inputted image signals and a plurality of latch circuits for holding the image signals transferred respectively from the shift registers and for outputting such hold signals;

a plurality of selector circuits each of which selects from among a plurality of level-shifted reference voltages one level-shifted reference voltage corresponding to the hold signal and outputs the level-shifted reference voltage selected;

a plurality of hold capacitors each of which is charged by the level-shifted reference voltage selected;

a plurality of source follower circuits each of which receives a hold voltage from the hold capacitor and outputs a driving voltage for the liquid crystal display;

a bias voltage source for supplying a reference bias voltage commonly to the plurality of source follower circuits; and a plurality of level shifting circuits each of which commonly receives the reference bias voltage applied from the bias voltage source and one of reference voltages whose levels are difference from one another and correspond to the respective gradations, and each of which outputs the level-shifted reference voltage shifted up by the amount of the reference bias voltage applied from the bias voltage source.

BRIEF DESCRIPTION OF THE DRAWINGS

The above and other objects, features and advantages of the present invention will be apparent from the following description of preferred embodiments of the invention, with reference to the accompanying drawings, in which.

PREFERRED EMBODIMENTS OF THE INVENTION

Throughout the following description, similar reference symbols or numerals refer to the same or similar elements in all figures of the drawings.

For the purpose of assisting in the understanding of the present invention, a conventional driving circuit for a liquid crystal display and the problems existing therein will first be described by making reference to FIG. 8 before the present invention is explained.

Figure 8:
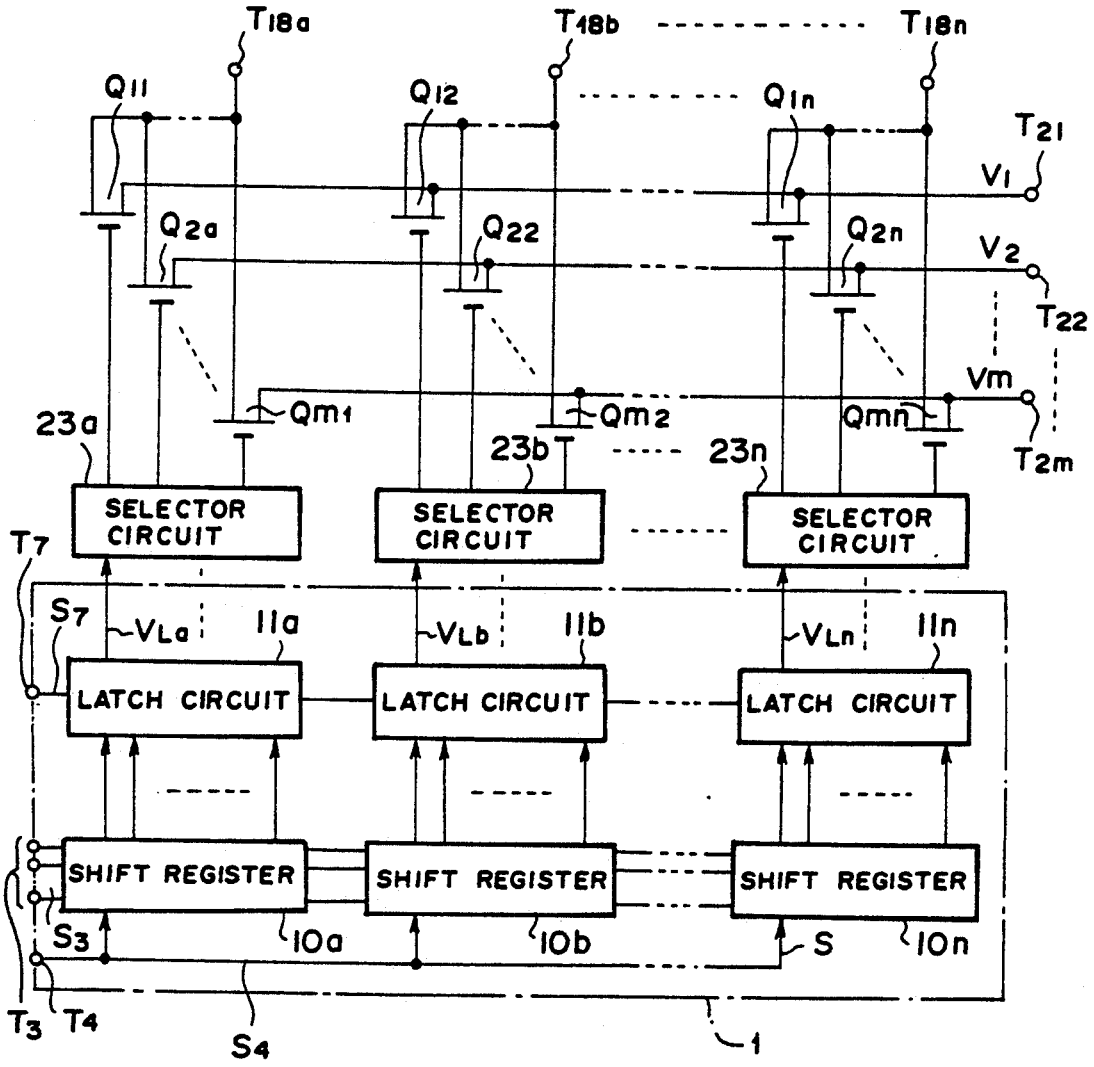
FIG.8 PRIOR ART
FIG. 8 shows a block diagram of an example of a conventional driving circuit for a liquid crystal display.

FIG. 8 shows, in a block diagram, an example of a conventional driving circuit for a liquid crystal display, which circuit is designed to effect the driving for the number m of gradations and for the number n of lateral stages.

Image signals $S_3$ of a digital type having the brightness information of m gradations are inputted from signal input terminals $T_3$ and are transferred to respective shift registers 10*a*–10*n* in a number n of stages in synchronization with clock pulses $S_4$ applied to a clock pulse input terminal $T_4$. The image signals transferred to the respective shift registers 10*a*–10*n* are then transferred to corresponding latch circuits 11*a*–11*n* in response to latch pulses $S_7$ applied to a latch pulse input terminal $T_7$.

Each of the latched or hold signals $V_{La}$–$V_{Ln}$ which was latched or held in each of the corresponding latch circuits 11*a*–11*n* is selected by each of corresponding selectors $\mathbf{23}_a$–$\mathbf{23}_n$ correspondingly provided at each of the a–n stages, any one of transistors of m number for each stage of output transistors $Q_{11}$–$Q_{m1}$ to $Q_{1n}$–$Q_{mn}$ connected respectively to driving output terminals $T_{18a}$–$T_{18n}$ for the liquid crystal display is turned to "ON" state one transistor at a time, and any desired one of power supply voltages $V_1$–$V_m$ respectively supplied from power supply terminals $T_{21}$–$T_{2m}$ is supplied to the liquid crystal display as a voltage of m gradations one voltage at a time.

Generally, the number m of gradations is, for example, 16 and the number n of stages is in the order of 100. The total number of the output driver transistors required then is 1,600.

It should be noted that, in the conventional driving circuit as explained above, the necessary number of the output transistors has to be increased as the number m of gradations increases so that a disadvantage in the integrated circuit constructed using such a circuit is that the output transistors occupy half of the chip area resulting in a large chip size and hence in a high manufacturing cost.

Especially, where the display area of a liquid crystal display panel is to be increased, it is necessary to enhance the driving capability of the output transistors and this necessitates an increase in the chip size for the output transistors and renders such circuit unsuitable to be fabricated in an integrated circuit construction. Further, in the conventional arrangement, it is necessary for the power supply circuit to have such an electric driving capability that is increased by the number m of gradations.

Now, an explanation of the first embodiment of the present invention is made by making reference to FIGS. 1 to 4.

Figure 1:
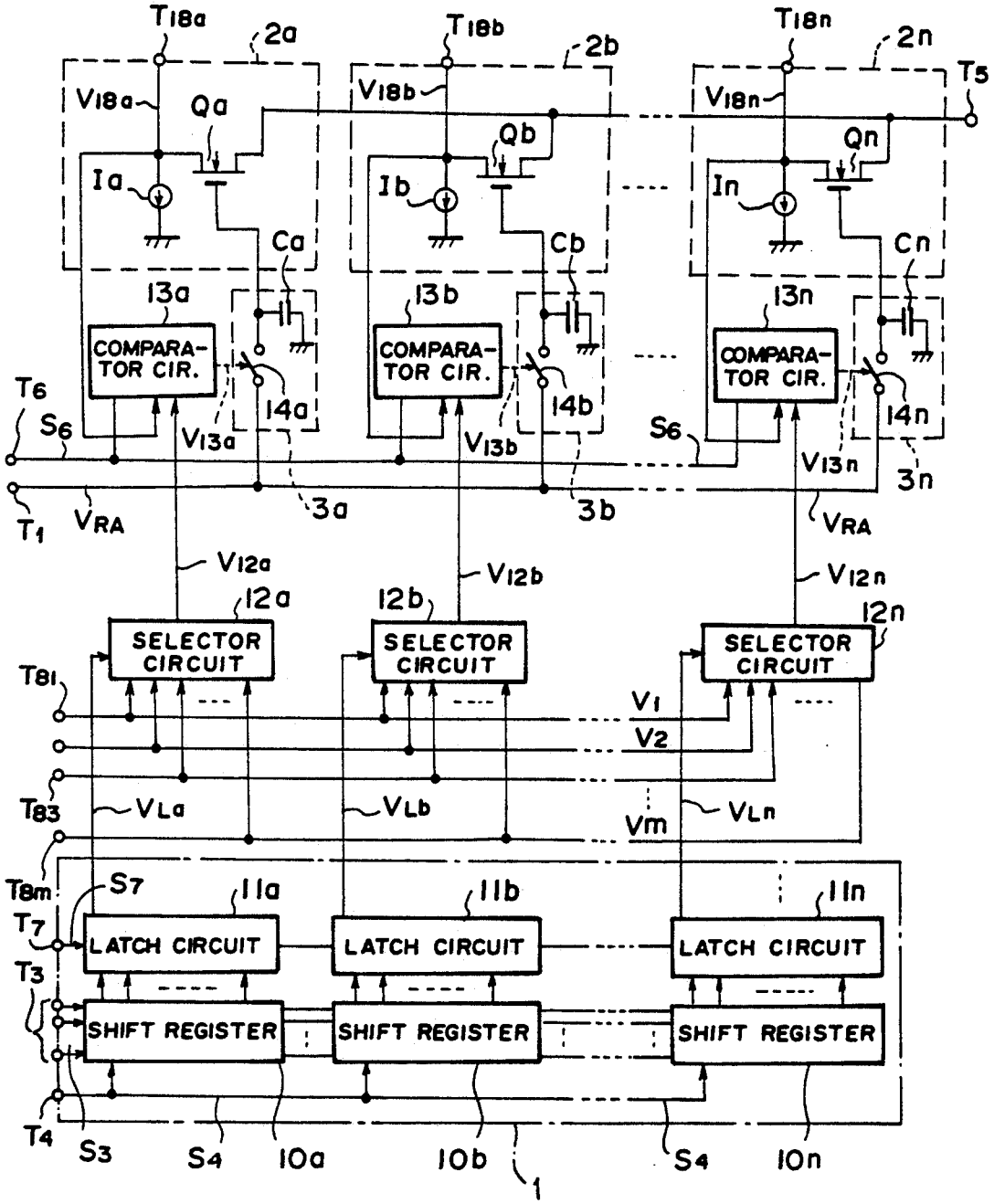
FIG. 1 shows a block diagram of a driving circuit of a first embodiment according to the present invention.

The driving circuit of this first embodiment shown in FIG. 1 includes a selector driving circuit 1 which has the same construction as that in the prior art arrangement shown in FIG. 8; a plurality of selector circuits 12*a*–12*n* each of which selects as a selected reference voltage one of reference voltages $V_1$–$V_m$ supplied from reference voltage terminals $T_{81}$–$T_{8m}$ is accordance with the corresponding one latched signal $V_{La}$–$V_{Ln}$ held by each of the latch circuits 11*a*–11*n*; a plurality of sampling circuits 3*a*–3*n* which receives commonly a ramp voltage $V_{RA}$ supplied from a terminal $T_1$ and each of which includes the corresponding one sampling capacitor Ca–Cn and the corresponding one sampling switch 14*a*–14*n*; a plurality of source follower circuits 2*a*–2*n* each of which includes only one corresponding output transistor Qa–Qn and the corresponding one constant-current source Ia–In; and a plurality of comparators 13*a*–13*n* each of which receives, at one input point, the corresponding liquid crystal driving voltage $V_{18a}$–$V_{18n}$ outputted from each of the source follower circuits 2*a*–2*n* and, at the other input point, the corresponding selected reference voltage $V_{12a}$–$V_{12n}$, compares the respective voltages inputted and operates to switch the corresponding sampling switch 14*a*–14*b* based on its comparator output voltage $V_{13a}$–$V_{13n}$.

Each of the plurality of source follower circuits 2*a*–2*n* comprises only the one output field effect transistor Qa–Qn having its drain connected to a power supply terminal T5, its gate connected to the output of said sampling circuit 3*a*–3*n*, and its source connected to the input of said comparator circuit 13*a*–13*n* and a constant-current source Ia–In.

Now, the operation of the driving circuit in FIG. 1 will be explained with reference to the various voltage waveforms shown in FIG. 2. The digital image signal $S_3$ which is inputted from the input terminal $T_3$ is transferred through the respective shift registers 10*a*–10*n* of the respective stages in synchronization with clock pulses $S_4$ applied from the clock pulse input terminal $T_4$ and the data for the next one horizontal period is latched or held in the latch circuits 11*a*–11*n* in response to the latch pulses $S_7$ applied from the latch pulse input terminal $T_7$.

Each of the selectors 12*a*–12*n* for the respective a–n n stages selects one of the reference voltages $V_1$–$V_m$ which corresponds to the corresponding one latched or hold signal $V_{La}$–$V_{Ln}$ sent from the selector driving circuit 1 and, then forwards out the reference voltage thus selected to one input terminal of the corresponding comparator circuit 13*a*–13*n*.

It is now assumed that initially all of the charged potentials of the sampling capacitors Ca–Cn in the sampling circuit 3*a*–3*n* for the respective stages are equal to zero, and all of the output voltages $V_{18a}$–$V_{18n}$ appearing at the respective output terminals $T_{18a}$–$T_{18n}$ of the source follower circuits 2*a*–2*n* and connected to the liquid crystal display are substantially at a ground potential.

The ramp voltage $V_{RA}$ which rises proportionally with respect to the time is inputted from the input terminal $T_1$.

Here begins the inputting of comparator clock pulses $S_6$ commonly to each of the comparators 13*a*–13*n* for the respective stages.

Each of the comparators 13*a*–13*n* respectively provided for the a–n stages compares the corresponding driving output voltage $V_{18a}$–$V_{18n}$ for the liquid crystal display with the corresponding one selected reference voltage $V_{12a}$–$V_{12n}$ selected by and forwarded from the corresponding selector circuit 12*a*–12*n*.

Figure 2:
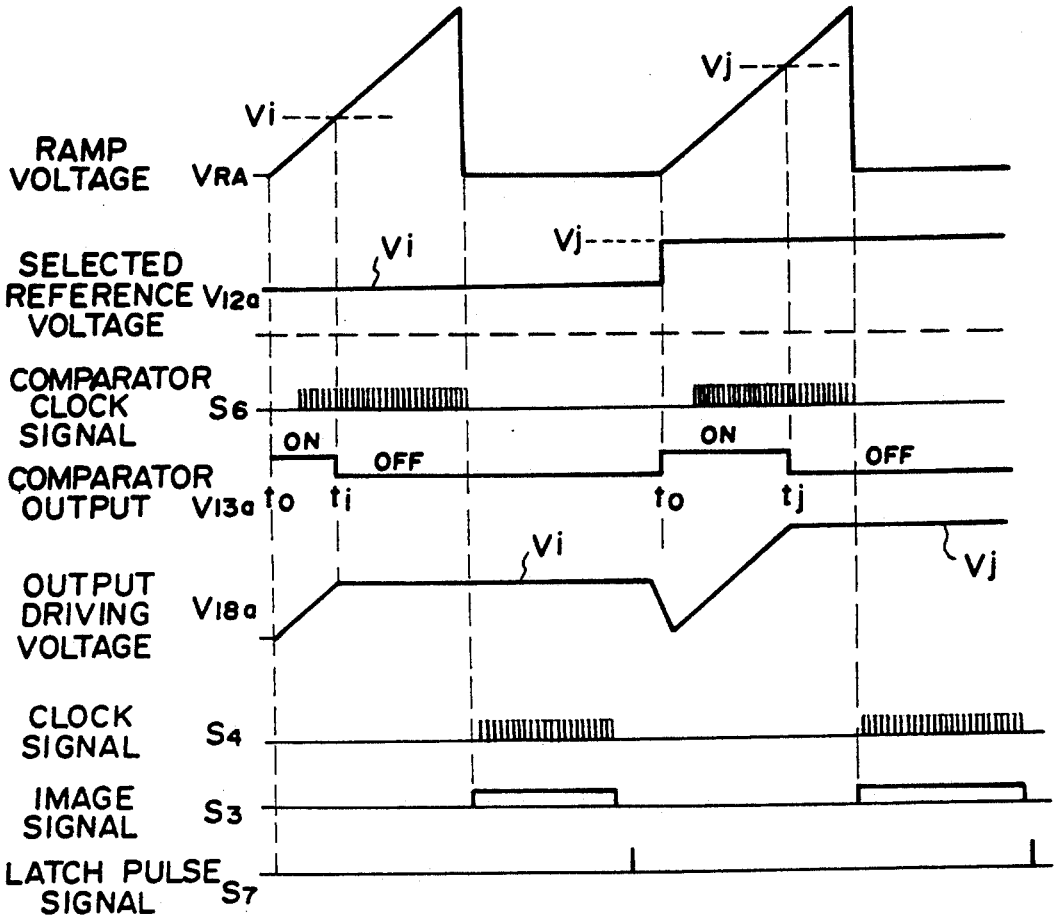
FIG. 2 shows signal waveforms at the various particular points in the circuit shown in FIG. 1.

In FIG. 2, the reference voltage $V_i$ selected at first is higher than the ramp voltage $V_{RA}$, so that the output voltages $V_{13a}$–$V_{13n}$ of comparators 13a–13n for the respective a-stages act to close the sampling switches 14a to 14n at the time point $t_0$. As a consequence, the respective sampling capacitors Ca–Cn are charged by the ramp voltage $V_{RA}$ and accordingly driving outputs corresponding to the selected reference voltage $V_i$ are outputted to the output terminals $T_{18a}$–$T_{18n}$ of the source follower circuits 2a–2n consisted of the constant-current sources Ia–In and the output driver transistors Qa–Qn for the respect a–n stages.

The ramp voltage $V_{RA}$ increases with the lapse of time and the respective output voltages $V_{18a}$–$V_{18n}$ for the respective stages also increase proportionally with the ramp voltage $V_{RA}$ and they finally exceed the selected reference voltages which are selected from the respective reference voltages $V_1$–$V_m$, which are, for example, the reference voltages $V_i$ and $V_j$ as shown in FIG. 2.

At the respective time points $t_i$ and $t_j$ when the output driving voltages exceed the respective reference voltages $V_i$ and $V_j$, the comparator output voltages $V_{13a}$–$V_{13n}$ of the respective a–n stages turn their states to low level and make the sampling switches 14a–14n of the respective stages opened.

As a result, for each of the output driving voltages $V_{18a}$–$V_{18n}$ for the respective stages, there is obtained a value corresponding to each of the signals latched or held in the respective latch circuits 11a–11n for the respective stages, which value here is $V_i$ or $V_j$.

Figure 3A:
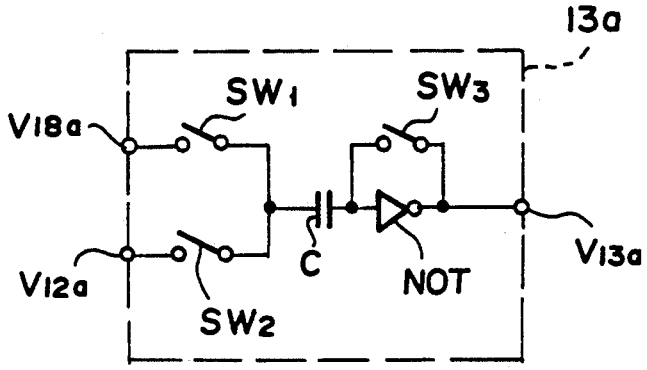
FIGS. 3*a* and 3*b* respectively show concrete circuit diagrams of the comparator circuit and the selector circuit shown in FIG. 1.
Figure 3B:
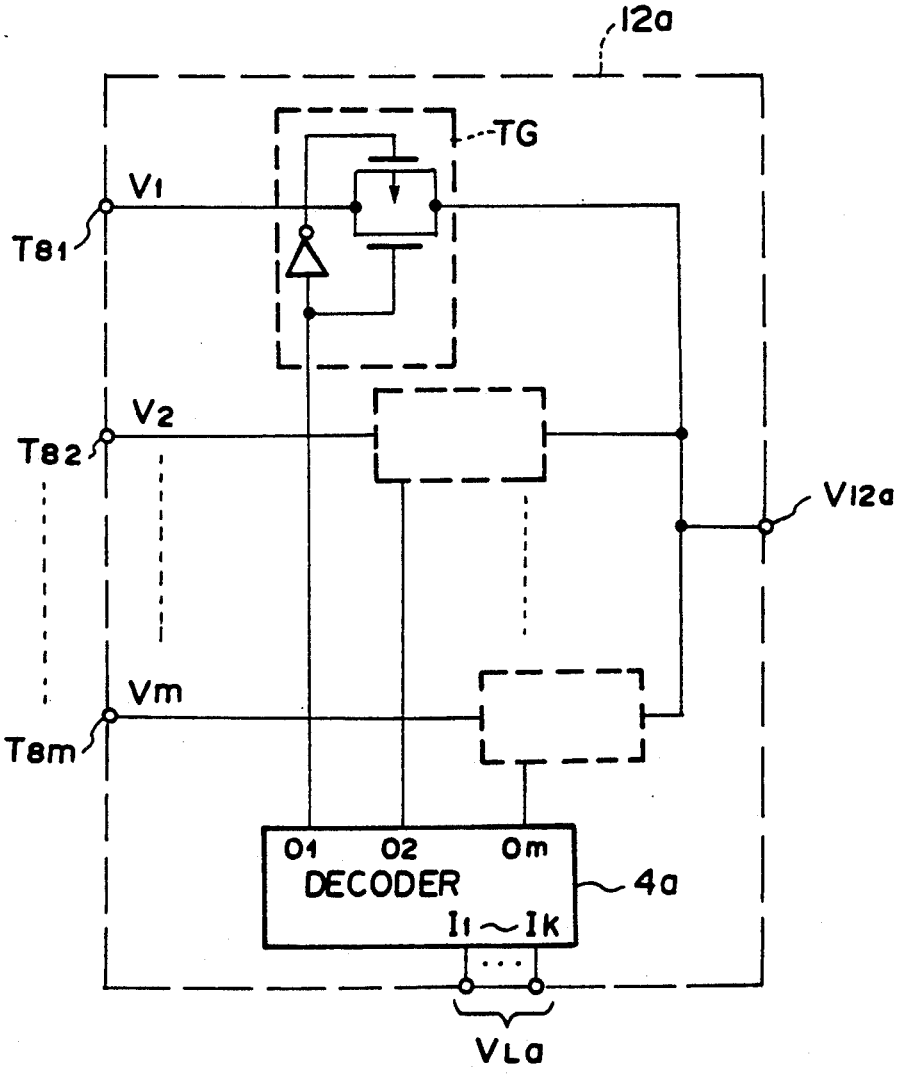

The output transistors Qa–Qn of the circuit shown in FIG. 1 are so arranged that only one transistor is used for each stage of a number of a–n stages. Further, as shown in FIGS. 3a and 3b respectively, each of the comparator circuits 13a–13n is so arranged that it is composed of three switches $SW_1$–$SW_3$, one capacitor C and one NOT gate circuit and, each of the selector circuits 12a–12n is so arranged that it is composed of one corresponding decoder 4a–4n and a number of m transfer gates TG, both of which arrangements are simple in their constructions. Thus, whereas it was necessary for the conventional arrangement as illustrated in FIG. 8 to have a number m×n of the output driver transistors $Q_{11}$–$Q_{mn}$, it is possible in the present embodiment to decrease the number of the transistors Qa–Qn to only n which corresponds merely to the number of stages, which allows a considerable reduction in the chip area on the integrated circuit device so that, for example, where the necessary number m of gradations is 16, the occupying chip area within the integrated circuit device will be reduced down to 60% of the total area.

Figure 4:
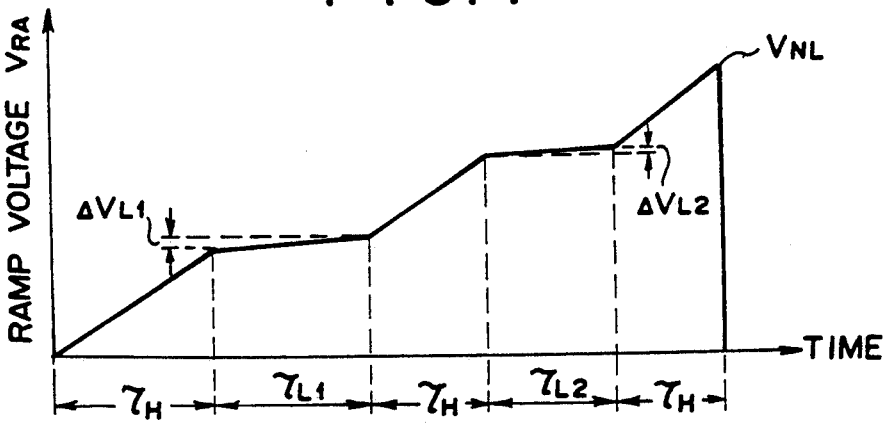
FIG. 4 shows a preferable example waveform of a ramp voltage applied commonly to the respective sampling circuits shown in FIG. 1.

FIG. 4 exemplarily shows one preferable waveform of the ramp voltage $V_{RA}$ which is commonly applied to the sampling circuits 3a–3n of the first embodiment.

Generally, in the driving operation of a liquid crystal display of an active matrix type, the range of voltages where the transmission factor changes significantly in accordance with the voltage variations is small. The ramp voltage $V_{RA}$ illustrated in FIG. 4 is of a non-linear voltage $V_{NL}$ including ranges of voltages $\Delta V_{L1}$ and $\Delta V_{L2}$ in which the transmission factor changes significantly, each of which ranges having a low rise-up rate time $\sigma_{L1}$, $\sigma_{L2}$, so that the resolution of image obtained is enhanced. Thus, the adoption of a non-liner ramp voltage $V_{NL}$ as shown in FIG. 4 enables the liquid crystal driving circuit to supply accurate and proper driving voltages to the liquid crystal display.

According to this first embodiment of the invention, the circuit comprises for each stage of a plurality of stages a sampling circuit, a source follower circuit and a comparator circuit, and at each stage the ramp voltage simultaneously inputted to the respective stages is charged up to the extent of the selected reference voltage correspondingly in response to the value of the data signal transferred. The driving circuit according to this invention does not require as many output driver transistors as the number of gradations unlike in the prior art arrangement and it is sufficient for the driving circuit to have only one output transistor for the source follower circuit in each stage and thus an integrated circuit device having a high integration or packing density can be achieved.

Figure 5:
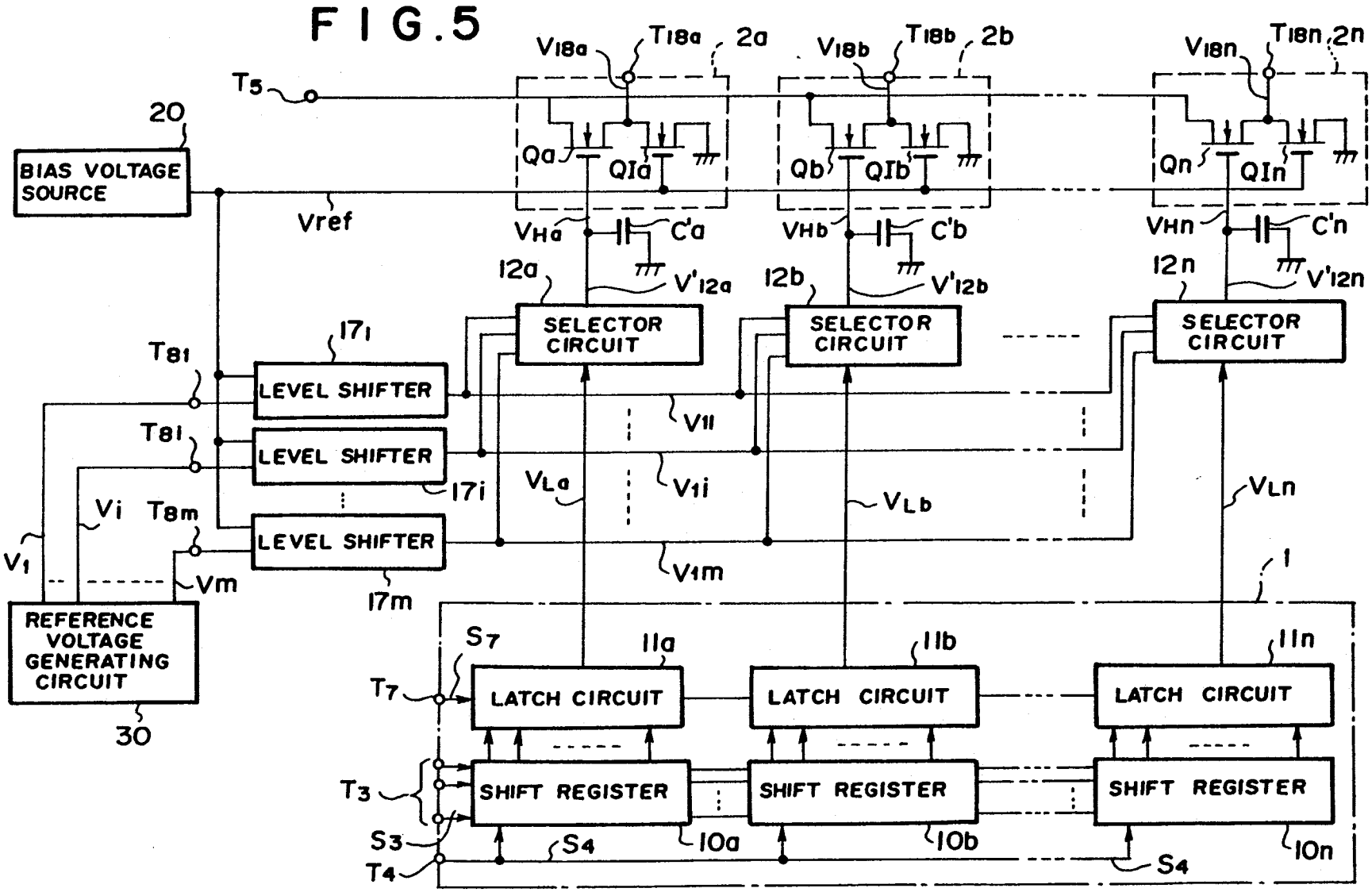
FIG. 5 shows a block diagram of a driving circuit of a second embodiment according to the present invention.

Next, FIG. 5 shows a circuit diagram of a driving circuit of the second embodiment according to the present invention.

The driving circuit of this second embodiment comprises firstly the selector driving circuit 1 which has the same construction as that of the first embodiment shown in FIG. 1. The driving circuit comprises also a plurality of selector circuits 12a–12n, each of which receives the latched or hold signals $V_{La}$–$V_{Ln}$ forwarded from the corresponding one latch circuit 11a–11n and also receives in a parallel manner a plurality of level-shifted reference voltages $V_{11}$–$V_{1m}$ sent out from a plurality of level shifting or biasing circuits $\mathbf{17}_1$–$\mathbf{17}_m$. The selector circuits $\mathbf{12a}$–$\mathbf{12}_n$ of the first embodiment in FIG. 1, a concrete circuit diagram of which is shown in FIG. 3(*b*), can be used in this second embodiment. A reference voltage generating circuit 30 supplies through the reference voltage terminals $T_{81}$–$T_{8m}$ to the level shifting or biasing circuits $\mathbf{17}_1$–$\mathbf{17}_m$ a plurality of reference voltages $V_1$–$V_m$ respectively, the potentials of which are different from one another and the number of levels of which corresponds to that of the gradations. The level shifting or biasing circuits $\mathbf{17}_1$–$\mathbf{17}_m$ also receive commonly at their bias voltage input terminals a reference bias voltage $V_{ref}$ which is sent from a bias voltage source 20. The outputs of the selector circuits 12a–12n are respectively connected to a plurality of hold capacitors C'a–C'n for holding the selected level-shifted reference voltages. They are also connected to a plurality of source follower circuits each of which is consisted of corresponding one output transistor Qa–Qn and constant current transistor $Q_{Ia}$–$Q_{In}$ and outputs an output voltage $V_{18a}$–$V_{18n}$ at its output terminal $T_{18a}$–$T_{18n}$ based on a hold signal $V_{Ha}$–$V_{Hn}$ held by the corresponding hold capacitor C'a–C'n. The respective gates of the constant current transistors $Q_{Ia}$–$Q_{In}$ commonly receive the reference bias voltage $V_{ref}$ sent from the bias voltage source 20.

Figure 6:
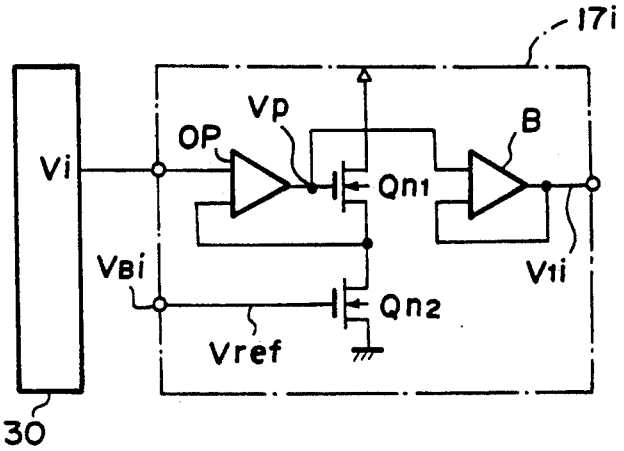
FIG. 6 shows a circuit diagram of the level shifting or biasing circuit shown in FIG. 5.

FIG. 6 shows a concrete circuit diagram of the level shifting or biasing circuit $\mathbf{17}_i$, representatively. The biasing circuit $\mathbf{17}_i$ is consisted of a source follower circuit formed by two n-channel field effect transistors $Q_{n1}$, $Q_{n2}$, an input operational amplifier OP and an output buffer amplifier B. An output voltage $V_P$ of the input operational amplifier OP is higher than the input reference voltage $V_i$ sent from the reference voltage generating circuit 30 by the amount of the reference bias voltage $V_{ref}$ applied to the bias voltage input terminal $V_{Bi}$ and, is sent out as the level-shifted reference voltage $V_{1i}$ commonly to all of the selector circuits 12a–12n.

Figure 7:
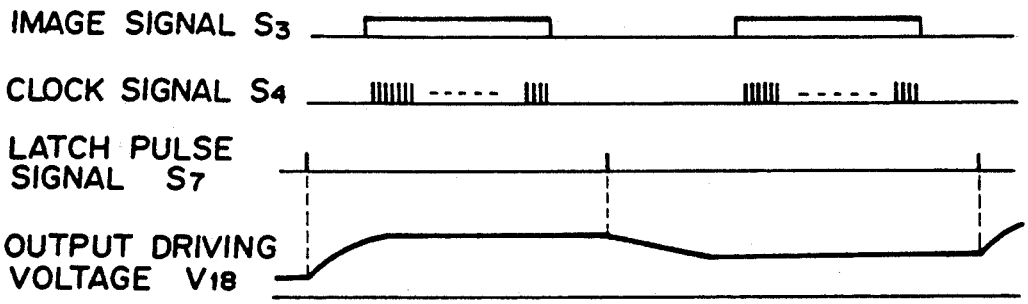
FIG. 7 shows signal waveforms at the various particular points in the circuit shown in FIG. 5.

Now, the operation of the driving circuit of this second embodiment will be explained hereunder with reference to the various signal waveforms shown in FIG. 7.

The processing manner of the inputted digital image signal $S_3$ in the selector driving circuit 1 and the outputting of the resultant latched or hold signals $V_{La}$–$V_{Ln}$ therefrom are the same as those achieved in the first embodiment in FIG. 1, so that the same explanation is not repeated here. The selector circuits 12a–12n respectively select one of the level-shifted reference voltages $V_{11}$–$V_{1m}$ sent commonly from the level shifting or biasing circuits $\mathbf{17}_1$–$\mathbf{17}_m$, based upon the corresponding latched or hold signals $V_{La}$–$V_{Ln}$ sent from the selector driving circuit 1, and then send out the respective selected level-shifted reference voltage $V'_{12a}$–$V'_{12n}$. Accordingly, the respective hold capacitors C'a–C'n are respectively charged by the corresponding selected level-shifted reference voltage $V'_{12a}$–$V'_{12n}$ and the respective hold voltages $V_{Ha}$–$V_{Hn}$ charged therein drive the output driver transistors Qa–Qn of the source follower circuits 2a–2n.

Assuming here that the output transistors Qa–Qn and the constant current transistors $Q_{Ia}$–$Q_{In}$, each corresponding pair constituting the corresponding source follower circuit 2a–2n for the respective stages, are designed to have the same dimensions with each other, the output driving voltage $V_{18a}$–$V_{18n}$ appearing at the corresponding output terminal $T_{18a}$–$T_{18n}$ is lower than the corresponding inputted hold voltage $V_{Ha}$–$V_{Hn}$ by the level of the voltage $V_{ref}$ applied commonly to the gates of the constant current field effect transistors $Q_{Ia}$–$Q_{In}$ as a reference biasing voltage. This means that the output driving voltages $V_{18a}$–$V_{18n}$ are inevitably deviated from the precise values which are based on the reference voltages $V_1$–$V_m$.

However, in this second embodiment of the invention, it can readily be understood from the foregoing explanation that, as the voltage inputted to each of the source follower circuits 2a–2n is biased or level shifted higher than the normal reference voltage by the level of the reference bias voltage $V_{ref}$, a precise output driving voltage can be outputted therefrom.

According to this second embodiment of the invention, the influence of the gate voltages of the respective constant current field effect transistors upon the output driving voltages can be perfectly compensated, so that the output driving voltages which precisely equal or correspond to the reference voltages and which have great driving capabilities can be outputted from the circuit.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. A driving circuit for a liquid crystal display of an active matrix type, said circuit comprising:

a selector driving circuit having a plurality of shift registers connected in cascade for transferring inputted image signals therethrough, and a plurality of latch circuits for holding said image signals transferred respectively from said shift registers and for outputting such hold signals;

a plurality of selector circuits each of which selects one reference voltage from among a plurality of inputted reference voltages, said one reference voltage corresponding to one of said hold signals, and one of said selector circuits outputting said selected reference voltage;

a plurality of sampling circuits each of which commonly receives a ramp voltage which changes its level proportionally with respect to time, each of said sampling circuits including a sampling capacitor and a sampling switch for controlling a sample holding operation;

a plurality of source follower circuits each of which receives a sample hold voltage from said sampling capacitor and outputs an output driving voltage for said liquid crystal display; and a plurality of comparator circuits each of which receives said output driving voltage from one of said source follower circuits and said selected reference voltage from one of said selector circuits, each of said comparator circuits comparing the levels between said output driving voltage and said selected reference voltage, and turning on said sampling switch responsive to said output driving voltage being lower than said selected reference voltage and turning off said sampling switch responsive to both said output driving voltage and said selected reference voltage becoming identical to each other.

2. A driving circuit for a liquid crystal display according to claim 1, in which each of said plurality of source follower circuits comprises an output field effect transistor having a gate connected to an output terminal of a corresponding one of said sampling circuits and a source/drain current path connected between an input terminal of one of said comparator circuits and a power supply terminal, and a constant-current source connected between a ground terminal and a junction node formed between said source/drain current path and said input terminal of one of said comparator circuits.

3. A driving circuit for a liquid crystal display according to claim 1, in which each of said comparator circuits comprises a capacitor, a NOT gate, a first, a second and a third switch means, one of two terminals of said first switch means connected to the output of one of said source follower circuits while one of two terminals of said second switch means connected to the output of one of said selector circuits, both the other terminals of said first and second switch means coupled through said capacitor to the input terminal of said NOT gate, and said third switch means connected across the input terminal and the output terminal of said NOT gate.

4. A driving circuit for a liquid crystal display according to claim 1, in which each of said selector circuits comprises one decoder and a plurality of transfer gates whose number corresponds to a necessary number of gradations, each of said transfer gates receiving at its input terminal one of said inputted reference voltages whose levels are different from one another and correspond to the respective gradations, receiving at its gate terminal one of decoder outputs from said decoder which receives at its input terminals one of said hold signals from one of said latch circuits, and outputting at its output terminal said reference voltage selected.

5. A driving circuit for a liquid crystal display according to claim 1, in which said ramp voltage commonly applied to said plurality of sampling circuits is of a non-linear voltage including ranges of voltages in which the transmission factor changes significantly, each of which ranges having a low rise-up rate time.

6. An integrated circuit device including therein a driving circuit for a liquid crystal display of an active matrix type, said driving circuit comprising:

a selector driving circuit having a plurality of shift registers connected in cascade for transferring an inputted image signal therethrough, and a plurality of latch circuits for holding said image signals transferred respectively from said shift registers and for outputting such hold signals;

a plurality of selector circuits each of which selects one reference voltage from among a plurality of inputted reference voltages, said selected one reference voltage corresponding to one of said hold signals, and one of said selector circuits outputs said selected reference voltage;

a plurality of sampling circuits each of which commonly receives a ramp voltage, said ramp voltage changing its level proportionally with respect to time, and each of said sampling circuits including a sampling capacitor and a sampling switch for controlling a sample holding operation;

a plurality of source follower circuits each of which receives a sample hold voltage from one of said sampling capacitors and outputs an output driving voltage for said liquid crystal display; and a plurality of comparator circuits each of which receives said output driving voltage from one of said source follower circuits and said selected reference voltage from one of said selector circuits, each of said comparator circuits comparing the levels between said output driving voltage and said selected reference voltage, and turning on one of said sampling switches in response to said output driving voltage being lower than said selected reference voltage and turning off said one of said sampling switches in response to both said output driving voltage and and selected reference voltage becoming identical with each other.

* * * * *